US010356848B2

(12) United States Patent
Samir et al.

(10) Patent No.: US 10,356,848 B2
(45) Date of Patent: Jul. 16, 2019

(54) LAMP HEATING FOR PROCESS CHAMBER

(71) Applicant: Applied Materials, Inc., Santa Clara, CA (US)

(72) Inventors: Mehmet Tugrul Samir, Mountain View, CA (US); Schubert S. Chu, San Francisco, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 575 days.

(21) Appl. No.: 15/012,495

(22) Filed: Feb. 1, 2016

(65) Prior Publication Data

US 2016/0227606 A1 Aug. 4, 2016

Related U.S. Application Data

(60) Provisional application No. 62/110,440, filed on Jan. 30, 2015, provisional application No. 62/141,133, filed on Mar. 31, 2015.

(51) Int. Cl.
*H05B 3/00* (2006.01)
*F26B 3/30* (2006.01)

(52) U.S. Cl.
CPC ..... *H05B 3/0047* (2013.01); *F26B 3/30* (2013.01)

(58) Field of Classification Search
CPC ..... H05B 3/0047; H01L 2924/0002; H01L 2924/00; H01L 22/12; F26B 3/30
(Continued)

(56) References Cited

U.S. PATENT DOCUMENTS 1,669,005 A * 5/1928 Hustadt ..... H05B 3/00 100/320
6,121,579 A * 9/2000 Aoki ..... C23C 16/481 118/730

(Continued)

FOREIGN PATENT DOCUMENTS

| | | | |
|---|---|---|---|
| JP | 2003-059853 | A | 2/2003 |
| KR | 10-1458963 | B1 | 11/2014 |
| WO | 2014-172174 | A1 | 10/2014 |

OTHER PUBLICATIONS

International Search Report dated Apr. 27, 2016 for Application No. PCT/US2016/012066.

(Continued)

*Primary Examiner* — Dana Ross
*Assistant Examiner* — Ket D Dang
(74) *Attorney, Agent, or Firm* — Patterson + Sheridan LLP

(57) ABSTRACT

A process chamber is provided including a top, a bottom, and a sidewall coupled together to define a volume. A substrate support is disposed in the volume. The process chamber further includes one or more lampheads facing the substrate support, each lamphead comprising an arrangement of lamps disposed along a plane. The arrangement of lamps is defined by a center and a plurality of concentric ring-shaped zones. Each ring-shaped zone is defined by an inner edge and an outer edge and each ring-shaped zone includes three or more alignments of one or more lamps. Each alignment of one or more lamps has a first end extending linearly to a second end that are separated by at least 10 degrees around the center. The first end and the second end are both located within one ring-shaped zone. Each alignment located within a same ring-shaped zone is equidistant to the center.

16 Claims, 7 Drawing Sheets

(58) Field of Classification Search
USPC ..... 392/411, 416, 418, 422, 424; 219/390, 219/405, 411, 443.1–468.2, 538–548; 118/724, 725, 50.1, 715, 723, 719, 730; 280/492.22, 495.1; 156/345.33, 345.52, 156/345.55
See application file for complete search history.

(56) References Cited

U.S. PATENT DOCUMENTS 6,891,131 B2 * 5/2005 Sakuma ..... C23C 16/481 118/501
7,045,746 B2 * 5/2006 Devine ..... F27B 17/0025 118/50.1
2006/0096972 A1 * 5/2006 Nakamura ..... H01L 21/67103 219/444.1
2006/0291823 A1 * 12/2006 Su ..... H01L 21/67115 392/318
2007/0238202 A1 * 10/2007 Ranish ..... H01L 22/12 438/14
2008/0298787 A1 * 12/2008 Suzuki ..... H01K 1/16 392/411
2010/0018960 A1 1/2010 Gat et al.
2011/0108195 A1 * 5/2011 Nishimoto ..... H01J 37/32192 156/345.37
2012/0171870 A1 * 7/2012 Mitrovic ..... C23C 16/45504 438/706
2013/0077293 A1 * 3/2013 Lee ..... F21V 29/677 362/184
2013/0264947 A1 * 10/2013 Ouderkirk ..... H01L 25/0753 315/151
2013/0284095 A1 * 10/2013 Ranish ..... H01L 21/02104 118/725

OTHER PUBLICATIONS

Chinese Office Action dated Mar. 13, 2019 for Chinese Application No. 201680006666.5.

* cited by examiner

LAMP HEATING FOR PROCESS CHAMBER

CROSS-REFERENCE TO RELATED APPLICATIONS

This application claims benefit of U.S. provisional patent application Ser. No. 62/110,440, filed Jan. 30, 2015 and U.S. provisional patent application Ser. No. 62/141,133, filed Mar. 31, 2015, which are both hereby incorporated herein by reference.

BACKGROUND

Field

Embodiments disclosed herein generally relate to lamp heating of process chambers used to process semiconductor substrates. More specifically, embodiments disclosed herein are related to arrangements of linear lamps for heating of semiconductor substrates.

Description of the Related Art

Various processes are used to form electronic devices on semiconductor substrates. Such processes include chemical vapor depositions, plasma enhanced chemical vapor depositions, atomic layer depositions, and epitaxy. These processes are performed in process chambers, and temperature control across the surface of the semiconductor substrate disposed within the process chambers facilitates uniform and consistent results during processing.

Lamps are often used to heat the semiconductor substrates during processing. The lamps are often arranged radially relative to the center of the lamp. For example, a plurality of vertical lamps having a bulb extending towards the substrate can be arranged along various radii from a center of the lamphead. While these arrangements can provide adequate temperature control of radial locations on the substrates being processed, the temperature control around the different angular locations of the substrate still suffers from non-uniformities. Other arrangements, such as a honeycomb arrangement having hundreds or even thousands of lamps can provide improved temperature control, but having hundreds or thousands of lamps is not a cost-effective solution.

Therefore, there is a need for an improved and more efficient design for lamp heating in semiconductor process chambers.

SUMMARY

Embodiments of the disclosure are generally related to lamp heating of process chambers used to process semiconductor substrates. In one embodiment, a process chamber is provided. The process chamber includes a top, a bottom, and a sidewall coupled together to define a volume. A substrate support disposed in the volume. The process chamber further includes one or more lampheads facing the substrate support, each lamphead comprising an arrangement of lamps disposed along a plane. The arrangement of lamps is defined by a center and a plurality of concentric ring-shaped zones about the center. Each ring-shaped zone is defined by an inner edge and an outer edge and each ring-shaped zone includes three or more alignments of one or more lamps. Each alignment of one or more lamps has a first end extending linearly to a second end that are separated by at least 10 degrees around the center. The first end and the second end of each alignment are both located within one ring-shaped zone. Each alignment located within a same ring-shaped zone is equidistant to the center.

In another embodiment, a process chamber is provided. The process chamber includes a top, a bottom, and a sidewall coupled together to define a volume. A substrate support is disposed in the volume. The process chamber further includes a lamphead facing the substrate support, the lamphead including an arrangement of lamps disposed along a plane. The arrangement of lamps is defined by a center and three or more sectors. Each sector defined by a first leg extending from the center to a first outer point, a second leg extending from the center to a second outer point, and a connecting portion between the first outer point and the second outer point. Each sector includes a plurality of linear lamps. Each linear lamp has a first end and a second end that are separated by at least 10 degrees around the center. The first end and the second of each linear lamp are both located within one sector. Each linear lamp of a sector is located at a different distance from the center.

In another embodiment a process chamber is provided. The process chamber includes a top, a bottom, and a sidewall coupled together to define a volume. The process chamber further includes a substrate support disposed in the volume. The substrate support has a plurality of substrate locations distributed around a central location of the substrate support, and each substrate location has a substrate supporting surface. The process chamber further includes a lamphead facing the substrate support. The lamphead includes an arrangement of lamps disposed along a plane that is substantially parallel to the substrate supporting surfaces of the substrate locations. The arrangement of lamps is defined by a center, from three to seven ring-shaped zones, and from three to seven sectors overlapping the three to seven ring-shaped zones. Each ring-shaped zone is concentric with the center of the plane and each ring-shaped zone is defined by an inner edge and an outer edge. Each sector is defined by a first leg extending from the center to a first outer point, a second leg extending from the center to a second outer point, and a connecting portion between the first outer point and the second outer point. Each linear lamp includes a first end and a second end that are both located within one ring-shaped zone and one sector. Each linear lamp extends at least 30 degrees around the center of the plane.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, common words have been used, where possible, to designate identical elements that are common to the figures. It is contemplated that elements disclosed in one embodiment may be beneficially utilized on other embodiments without specific recitation.

DETAILED DESCRIPTION

The present disclosure relates generally to lamp heating of process chambers used to process semiconductor substrates. More specifically, embodiments disclosed herein are related to arrangements of linear lamps for heating of semiconductor substrates.

In this disclosure, the terms "top", "bottom", "side", "above", "below", "up", "down", "upward", "downward", "horizontal", "vertical", and the like do not refer to absolute directions. Instead, these terms refer to directions relative to a basis plane of the chamber, for example a plane parallel to a substrate processing surface of the chamber. Furthermore, because this application discloses lampheads 200 and 300 that may be provided above or below a substrate support, any specific example given for a lamphead or lamp arrangement above the substrate support should be understood by the reader to also include a similar or mirror image lamphead or lamp arrangement below the substrate support without specific recitation of that lamphead or lamp arrangement below the substrate support.

Figure 1:
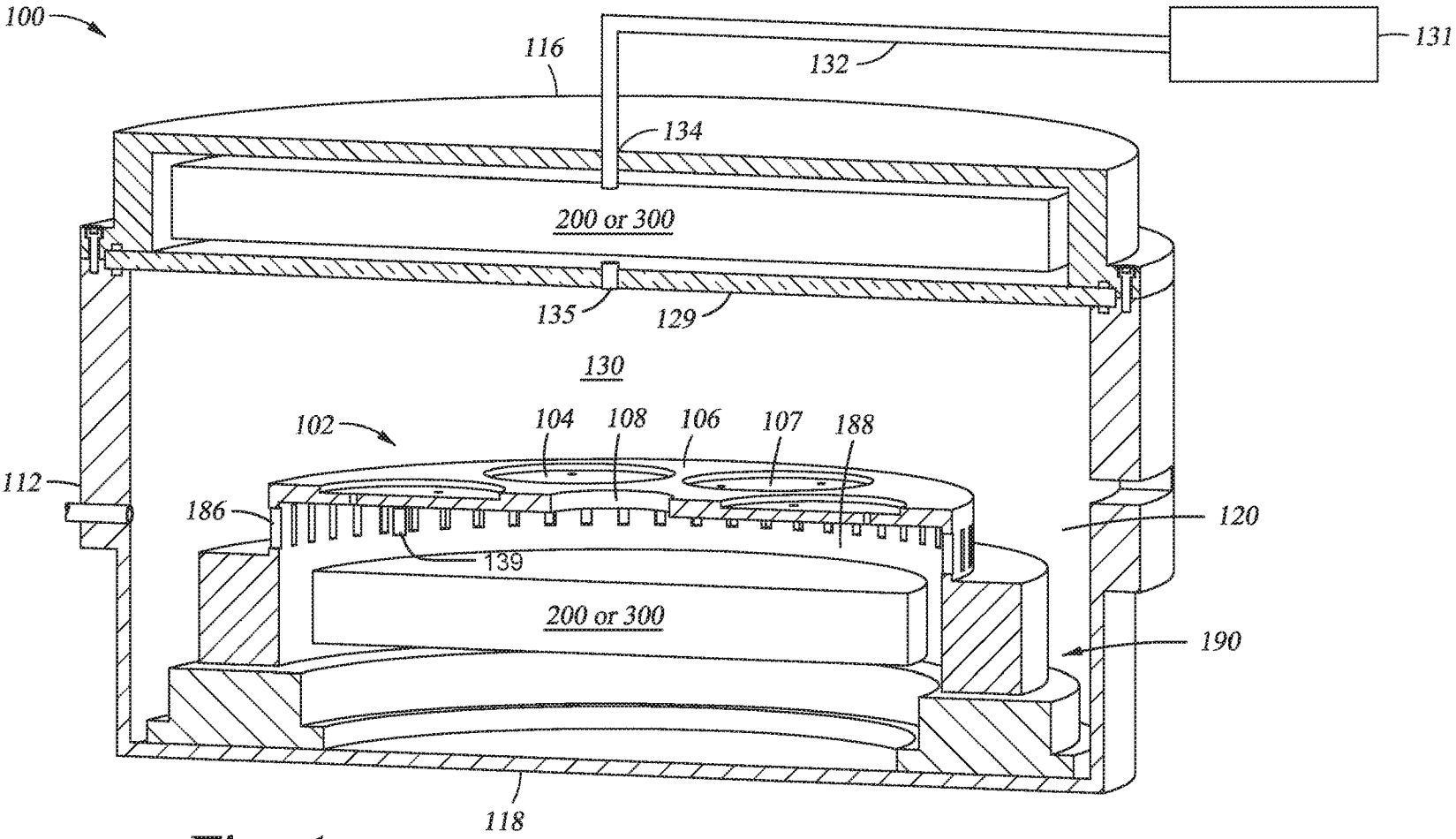
FIG. 1 is a side sectional view of a process chamber, according to one embodiment.

FIG. 1 is a perspective cross-sectional view of a process chamber 100 according to one embodiment. The process chamber 100 generally features a substrate support 102 having multiple substrate locations 104 on a processing surface 106 thereof, the substrate support 102 having a central opening 108 that provides uniform gas flow and exposure across the processing surface 106.

The chamber 100 has a top 116 and a bottom 118 that, together with the sidewall 112, define a volume 120 of the process chamber 100. The substrate support 102 is disposed within the volume 120.

Coupled at the top 116 of the process chamber 100 is a lamphead 200 including an arrangement 207 of lamps (see FIGS. 2A-2C) or a lamphead 300 including an arrangement 307 of lamps (see FIGS. 3A-3C) that project heat into the volume 120 toward the substrate support 102. The lampheads 200, 300 each include one or more types of heat sources, such as linear lamps and vertically oriented lamps that are described in fuller detail below. The lamphead 200 or the lamphead 300, may also be coupled to the chamber 100 at the bottom 118. Furthermore, in some embodiments, there may be a lamphead, such as lamphead 200 and/or a lamphead 300, at the top 116 and at the bottom 118. The lampheads 200, 300 may have reflective internal surfaces to increase the efficiency of power delivery to the processing surface 106 of the substrate support 102. Furthermore, in some embodiments each lamp in the lampheads 200, 300 may be disposed in a reflective tube to maximize power delivery from each lamp. Additionally, power delivery may be attenuated in a central region of the lamphead 200, 300 to avoid radiating excessive power through the central opening 108 of the substrate support 102.

A divider 129 may separate the lamphead 200, 300 at the top 116 of the chamber 100 from the volume 120 adjacent to the processing surface 106. The divider 129 and the processing surface 106 together define a processing region 130. The divider 129 may be a thermally resistant material, such as quartz, and may be transparent to energy emitted from the lamphead 200 to transmit the energy into the processing region 130. The divider 129 may also be a barrier to gas flow between the lamphead 200 and the processing region 130.

Interior surfaces of the lamphead 200 or 300 at the top 116 of the chamber 100, with the exception of the surface of the divider 129, may be lined or coated with a reflective material if desired. The reflective material may be any reflective material capable of withstanding the environment of the lampheads 200, 300. A cooling gas source 131 may be connected to the lamphead 200 through a gas conduit 132 and a portal 134 to maintain a temperature of the interior surfaces of the lamphead 200 at a desired level to avoid damage to the interior surfaces. The cooling gas may be an inert gas. A cooling gas source (not shown) may also be coupled to a lamphead 200, 300 disposed below the substrate support 102. Reflective materials that may be used include gold, silver, or other metals, and dielectric reflectors. The surface of the divider 129 facing the lamphead 200, 300 may be coated with an anti-reflective material, if desired. A divider similar to the divider 129 may be placed between a lamphead 200, 300 placed below the substrate support 102.

The substrate support 102 is rotatable, and may be rotated by a rotation assembly (not shown), such as a magnetic rotation assembly. If the substrate support 102 is rotated from the center of the substrate support 102, such as by a central shaft, then a lamphead 200, 300 disposed below the substrate support 102 may be configured to accommodate such a design. For example, in one embodiment, the lamphead 200, 300 may have an opening to allow connection of the central shaft to the substrate support 102. In another embodiment, the lamphead 200, 300 disposed below the substrate support 102 can include separate pieces mounted around the central shaft, such as three to six separate pieces mounted around the central shaft. Using a lamphead design with separate pieces mounted around a central shaft can allow for easier maintenance of the lamphead as well as the substrate support and the rotation mechanism for the substrate support.

In an embodiment in which a lamphead 200, 300 is not disposed below the substrate support 102, a reflector (not shown) may be disposed in the interior 188 of the substrate support 102 to reflect any radiation that propagates through the opening 108, or is transmitted or radiated by the substrates or the substrate support 102, back toward the substrate supporting surface 107 of the substrate support 102. The reflector may have a reflective member and a support member. The support member may be coupled to the bottom 118 of the chamber 100, or may extend through the bottom to an optional actuator, which may extend or retract the reflective member.

Temperature sensors, such as pyrometers, may be disposed in various locations in the chamber 100 to monitor various temperatures that may be significant for particular processes. A first temperature sensor 139 may be disposed in and/or through one or more of the substrate locations 104 to allow the temperature sensor 139 unlimited access to the substrate for monitoring a temperature of the substrate. If the substrate support 102 is rotated, the first temperature sensor 139 may have wireless power and data transmission. A second temperature sensor 135 may be disposed in, on, or through the divider 129 to view substrates disposed in the substrate locations 104 and/or the substrate supporting surface 107 to monitor temperatures of those components. The second temperature sensor 135 may be wired or wireless.

Figure 2A:
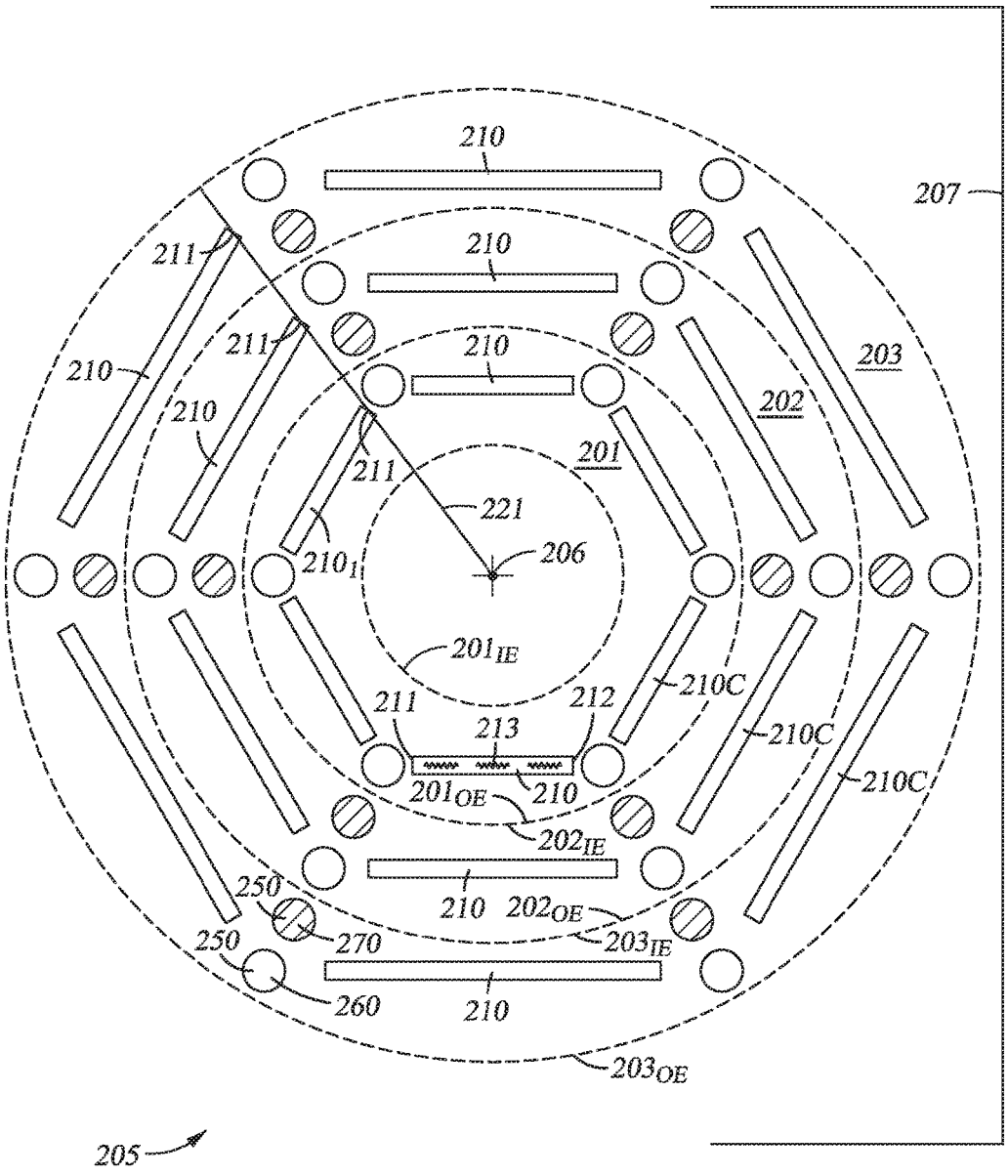
FIGS. 2A and 2B are top sectional plan views of an arrangement of lamps, according to one embodiment.
Figure 2B:
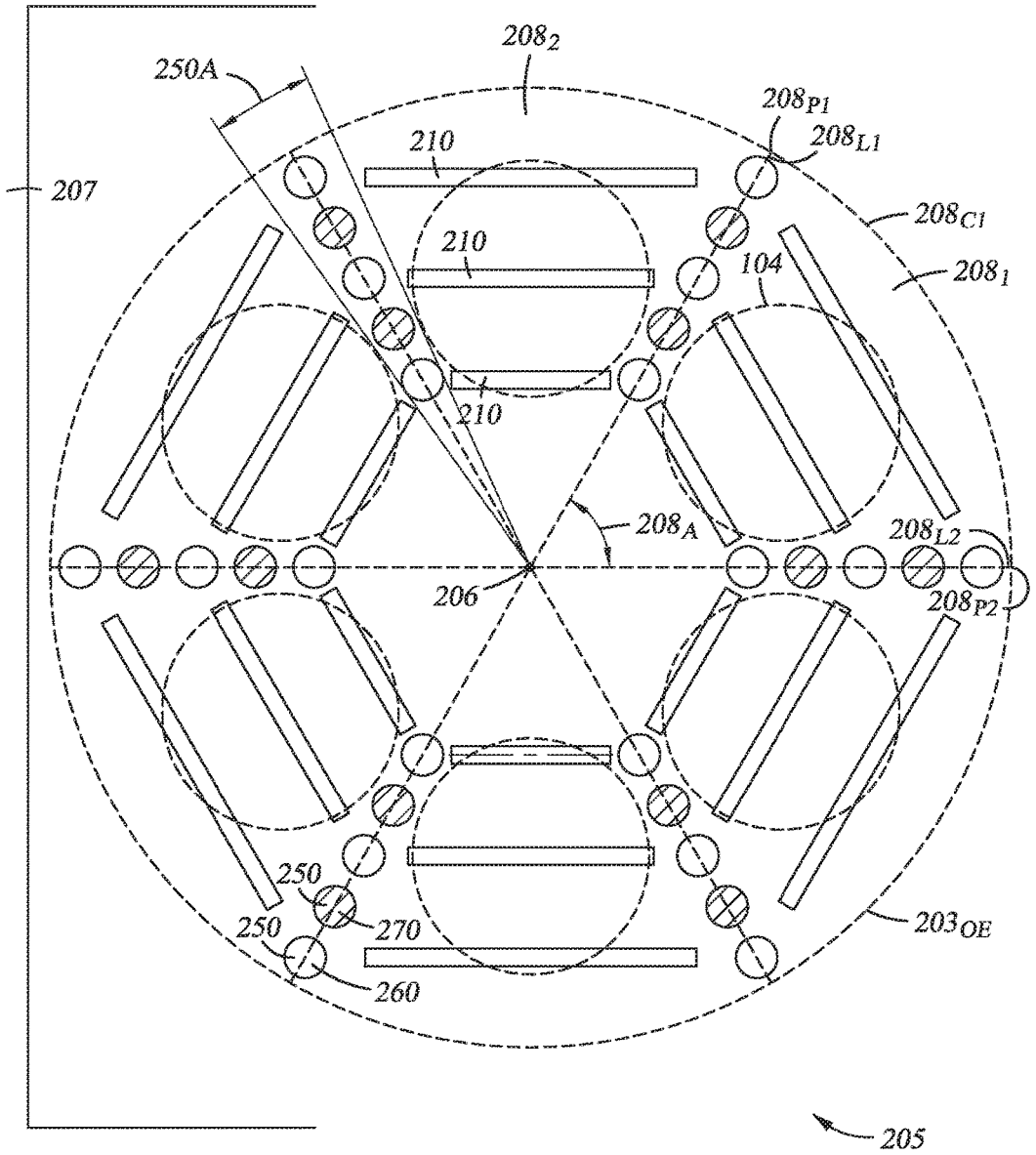

FIGS. 2A and 2B are top sectional plan views of a lamphead 200 including an arrangement 207 of lamps, according to one embodiment. FIGS. 2A and 2B are essentially the same view of the arrangement 207 of lamps in the lamphead 200 taken from a different perspective. Both FIGS. 2A and 2B illustrate the arrangement 207 of lamps having a center 206 and including a plurality of linear lamps 210 disposed along a plane 205. FIG. 2A is a view of the arrangement 207 of lamps in a radial perspective, showing the arrangement 207 of lamps divided into concentric ring-shaped zones 201-203. FIG. 2B is a view of the arrangement 207 of lamps using an angular perspective, showing the arrangement 207 of lamps divided into sectors 208 extending from the center 206 of the arrangement 207 of lamps.

Although in FIGS. 2A and 2B the plane 205 is circular, and other references to circular geometry, such as a radial perspective, may be used herein, this disclosure is not limited to circular geometries. For example, a "ring-shaped zone" used herein can refer to any structure in which an inner edge surrounds an interior area and an outer edge surrounds the inner edge. Although this interior area is shown as open area without lamps or other heating sources in some embodiments, this interior area may include lamps or other heating sources. Furthermore, a "sector" used herein refers to an area formed by a first leg extending from a center point to a first outer point and a second leg extending from the center point to a second outer point and a connecting portion between the first outer point and the second outer point. The connecting portion can include one or more segments that can be straight or curved.

The arrangement 207 of lamps includes the center 206 that can also be a center of the lamphead 200. The plane 205 over which the arrangement 207 of lamps is disposed can be substantially parallel to the substrate supporting surfaces 107 (see FIG. 1) of the substrate locations 104. The linear lamps 210 can direct radiation towards substrates located on the substrate supporting surfaces 107 of the substrate locations 104. Examples of suitable lamps to be used as the linear lamps 210 can include tungsten-halogen lamps, mercury vapor lamps, and carbon filament infrared emitters.

Referring to FIG. 2A, the arrangement 207 can be divided into the plurality of ring-shaped zones 201-203. Each ring-shaped zone 201-203 may include at least three linear lamps 210. Each linear lamp 210 can also be referred to as an alignment of one lamp due to the linear extension of the linear lamp 210 from a first end 211 to a second end 212 as described below. Each ring-shaped zone 201-203 can be defined by an inner edge (e.g., $\mathbf{201}_{IE}$, $\mathbf{202}_{IE}$, $\mathbf{203}_{IE}$) and an outer edge (e.g., $\mathbf{201}_{OE}$, $\mathbf{202}_{OE}$, $\mathbf{203}_{OE}$). The ring-shaped zones 201-203 may be non-overlapping, where each ring-shaped zone either surrounds another ring-shaped zone and/or is surrounded by another ring-shaped zone. Furthermore, each ring-shaped zone 201-203 may contact one of the other ring-shaped zones. For example, the outer edge $\mathbf{201}_{OE}$ of a first ring-shaped zone 201 may be the same as the inner edge $\mathbf{202}_{IE}$ of a second ring-shaped zone 202.

Each ring-shaped zone 201-203 includes a plurality of linear lamps 210. Each linear lamp 210 includes a first end 211 and a second end 212. The first end 211 and the second end 212 for each linear lamp 210 can both be located within one ring-shaped zone, such as the first ring-shaped zone 201. Each linear lamp 210 located within a ring-shaped zone, such as the first ring-shaped zone 201, can be located at a different angular location relative to the center 206 of the arrangement 207. Furthermore, each linear lamp 210 located within a ring-shaped zone, such as the first ring-shaped zone 201, may be equidistant from the center 206 of the arrangement 207. For, example a center point 210C of each linear lamp 210 located within a ring-shaped zone 201-203, such as the first ring-shaped zone 201, may be equidistant from the center 206. Furthermore, in some embodiments, for each given linear lamp 210 located within a ring-shaped zone, such as the first ring-shaped zone 201, there may be an opposing linear lamp 210 positioned 180 degrees away from that given linear lamp 210 and aligned parallel to the given linear lamp 210. In other embodiments, no two linear lamps located within a ring-shaped zone are aligned parallel with each other.

Although FIG. 2A shows that the arrangement 207 of lamps includes three ring-shaped zones 201-203, in some embodiments the plurality of ring-shaped zones can include from two to eleven ring-shaped zones, such as from three to seven ring-shaped zones. In some embodiments, the width of each ring-shaped zone (i.e., the distance between the outer edge and the inner edge of the ring-shaped zone) can be the same, so that uniform spacing between linear lamps 210 in directions away from the center 206 can aid in temperature control of the process chambers that are symmetrical about the center of the process chamber. Furthermore, the distance between an outer edge (e.g., outer edge $\mathbf{201}_{OE}$) and an inner edge (e.g., inner edge $\mathbf{201}_{IE}$) of each ring-shaped zone (e.g., first ring-shaped zone 201) can be less than one third of the distance between the center 206 of the arrangement 207 and the outer edge (e.g., outer edge $\mathbf{203}_{OE}$) of an outermost ring-shaped zone (e.g., ring-shaped zone 203).

In some embodiments, each linear lamp 210 can extend at least 10 or at least 15 degrees around the center 206 of the arrangement 207 from the first end 211 to the second end 212 of that linear lamp 210. In other embodiments, each linear lamp 210 can extend at least 30 degrees around the center 206 of the arrangement 207 from the first end 211 to the second end 212 of the linear lamp 210.

A first end 211 of a first linear lamp $\mathbf{210}_1$ in the first ring-shaped zone 201 can be positioned at a same angular location 221 relative to the center 206 of the arrangement 207 as a first end 211 of a second linear lamp $\mathbf{210}_2$ in the second ring-shaped zone 202. In some embodiments, this pattern of having a linear lamp with a first end located at a same angular location can be repeated for every ring-shaped zone, or other patterns may be used, such as every other ring-shaped zone.

The arrangement 207 of lamps can further include a plurality of additional heat sources 250, such as a plurality of vertically oriented lamps 260 and/or a plurality of coherent radiation sources 270. Used herein, coherent radiation refers to a radiation source that emits radiation having a coherence length greater than a distance between the coherent radiation source 270 and the substrate support 102. The vertically oriented lamps 260 and the coherent radiation sources 270 can be used to finely tune the temperature control (e.g., hot spots and cold spots) inside the process chamber 100. Each heat source 250, such as a vertically oriented lamp 260 and/or a coherent radiation source 270, may have a surface to emit radiation (e.g., a bulb for the vertically oriented lamp 260) that only extends a few degrees around the center 206, such as less than 10 degrees around the center 206, or less than 5 degrees around the center 206 as shown by the angular area 250A in FIG. 2B. The vertically oriented lamp 260 and the coherent radiation source 270 are only two examples of additional heat sources 250 that can be added to the lamphead 200 to provide fine tuning of the temperature control in the process chamber 100, and other heat sources known in the field may be used as well.

A vertically oriented lamp 260 can be positioned at an angular location between each linear lamp 210 located within some or all of the ring-shaped zones 201-203, such as the first ring-shaped zone 201. Similarly, a coherent radiation source 270 can be positioned at an angular location between each linear lamp 210 located within some or all of the ring-shaped zones, such as the first ring-shaped zone 201. Although FIG. 2A shows a vertically oriented lamp 260 and/or a coherent radiation source 270 between each linear lamp 210 in an angular direction, other arrangements are possible. For example, some arrangements may include two or more linear lamps, such as linear lamps 210, in a row in an angular direction or two or more vertically oriented lamps, such as vertically oriented lamps 260, in a row in an angular direction. Furthermore, in some embodiments, only vertically oriented lamps 260 or only coherent radiation sources 270 may be used. Additionally, in some embodiments only linear lamps 210 may be used.

The vertically oriented lamps 260 may have power connections at a first end pointed toward the top 116 of the chamber 100 (see FIG. 1) and emitters extending to a second end pointed toward the processing surface 106 of the substrate support 102. Examples of suitable lamps to be used as the vertically oriented lamps 260 can include tungsten-halogen lamps, mercury vapor lamps, and carbon filament infrared emitters. Each vertically oriented lamp 260 may be disposed in a reflective tube to maximize power delivery from each lamp. The coherent radiation sources 270 can be, for example, a laser source, such as laser diode arrays having power connections pointed towards the top 116 of the chamber 100 and emitters pointed toward the processing surface 106 of the substrate support 102. The power supplied to the vertically oriented lamps 260 and/or the coherent radiation sources 270 may be adjusted to finely tune temperatures in the chamber during processing. In some embodiments, different types or sizes of vertically oriented lamps and/or coherent radiation sources may be used at different locations in the lamphead 200. For example, longer or more powerful vertically oriented lamps may be used in the outer regions of the lamphead to account for increased heat loss that may occur in the outer areas of the process chamber.

FIG. 2A shows the linear lamps 210 arranged in sets of three, where the first end 211 of each linear lamp 210 in the set is positioned at a same angular location (see e.g., angular location 221) at different distances from the center 206 of the arrangement 207. Similarly, FIG. 2A shows the vertically oriented lamps 260 and the coherent radiation sources 270 arranged in sets of five, where each vertically oriented lamp 260 and each coherent radiation source 270 is centered along a same angular location. Other embodiments may be contemplated as well, such as embodiments in which the linear lamps 210 as well as the vertically oriented lamps 260 and the coherent radiation sources 270 in the different ring-shaped zones are staggered in an angular direction. For example, every linear lamp 210, vertically oriented lamp 260, and coherent radiation source 270 in the second ring-shaped zone 202 may be offset by 5 degrees from the corresponding linear lamp 210, vertically oriented lamp 260, and coherent radiation source 270 in the first ring-shaped zone 201. Furthermore, different numbers of lamps may be used in the sets, for example more or less than 3 linear lamps 210, and more or less than 5 members in the sets of vertically oriented lamps 260 and coherent radiation sources 270 may be used.

Referring to FIG. 2B, the arrangement 207 can be divided into the plurality of sectors 208. Each sector 208 can be defined by a first leg extending from the center 206 of the arrangement 207 to a first outer point, a second leg extending from the center 206 of the arrangement 207 to a second outer point, and a connecting portion between the first outer point and the second outer point. For example, a first sector $\mathbf{208}_1$ can be defined by a first leg $\mathbf{208}_{L1}$ extending from the center 206 to a first outer point $\mathbf{208}_{P1}$, a second leg $\mathbf{208}_{L2}$ extending from the center 206 to a second outer point $\mathbf{208}_{P2}$, and a connecting portion $\mathbf{208}_{C1}$ between the first outer point $\mathbf{208}_{P1}$ and the second outer point $\mathbf{208}_{P2}$. Each sector 208 can cover a different angular area of the plane 205. For example, the first sector $\mathbf{208}_1$ covers an angular defined by the angle 208A. In some embodiments, each sector can span the same angular area, such as the area defined by angle $\mathbf{208}_A$. The first leg and the second leg of each sector 208 can contact or coincide with a first leg and second leg of other sectors 208, so that the total area of the plane 205 can be filled by the sectors 208. Furthermore, the vertically oriented lamps 260 and the coherent radiation sources 270 can be described as being positioned along a shared leg (e.g., first leg $\mathbf{208}_{L1}$) extending from the center 206 of the arrangement 207 between a first sector $\mathbf{208}_1$ and a second sector $\mathbf{208}_2$. Although FIG. 2B shows that the arrangement 207 of lamps includes six sectors 208, in some embodiments the plurality of sectors can include from two to eleven sectors, such as from three to seven sectors.

As discussed above, each linear lamp 210 can extend at least 10 or at least 15 degrees around the center 206 of the arrangement 207 from the first end 211 to the second end 212 of that linear lamp 210. In other embodiments, each linear lamp 210 can extend at least 30 degrees around the center 206 of the arrangement 207 from the first end 211 to the second end 212 of the linear lamp 210. For example, in FIG. 2A six linear lamps 210 are shown extending around the center 206 in each ring-shaped zone, so these linear lamps 210 would extend somewhat less than 60 degrees around the center 206, such as at least 50 degrees due to the spaces between the linear lamps 210.

Each sector 208 can include a plurality of the linear lamps 210. The first end 211 and the second end 212 of each linear lamp 210 can both be located within one sector 208. Each linear lamp 210 located within a sector 208 can be disposed at a different distance from the center 206 of the arrangement 207. Furthermore, the first end 211 of each linear lamp 210 located within a sector 208 can be disposed at a same angular location as the first end 211 of the other linear lamps 210 located within the same sector 208.

In some embodiments, each sector 208 can overly a separate substrate location 104. Such a design may be useful when a substrate support does not rotate, so that the temperature of each substrate may be largely controlled by the linear lamps of a given sector. Although FIG. 2B is shown with the sectors overlying different substrate support locations, this is only one potential design to be used with the lamp arrangements disclosed herein. For example, in some embodiments two or more sectors may overly one substrate location, or one sector may overly more than one substrate location. Furthermore, this arrangement of lamps also provides benefits for heating single-substrate process chambers. For single-substrate process chambers, the substrate may be placed in a central area of the substrate support and the linear lamps may overly this central area as well as the outer areas. In some embodiments to be used with single-substrate process chambers, the center of the lamphead may include an arrangement of closely packed vertically oriented lamps or closely packed coherent radiation sources. In other embodiments, an array of linear lamps may overly the central area of the substrate support.

Figure 2C:
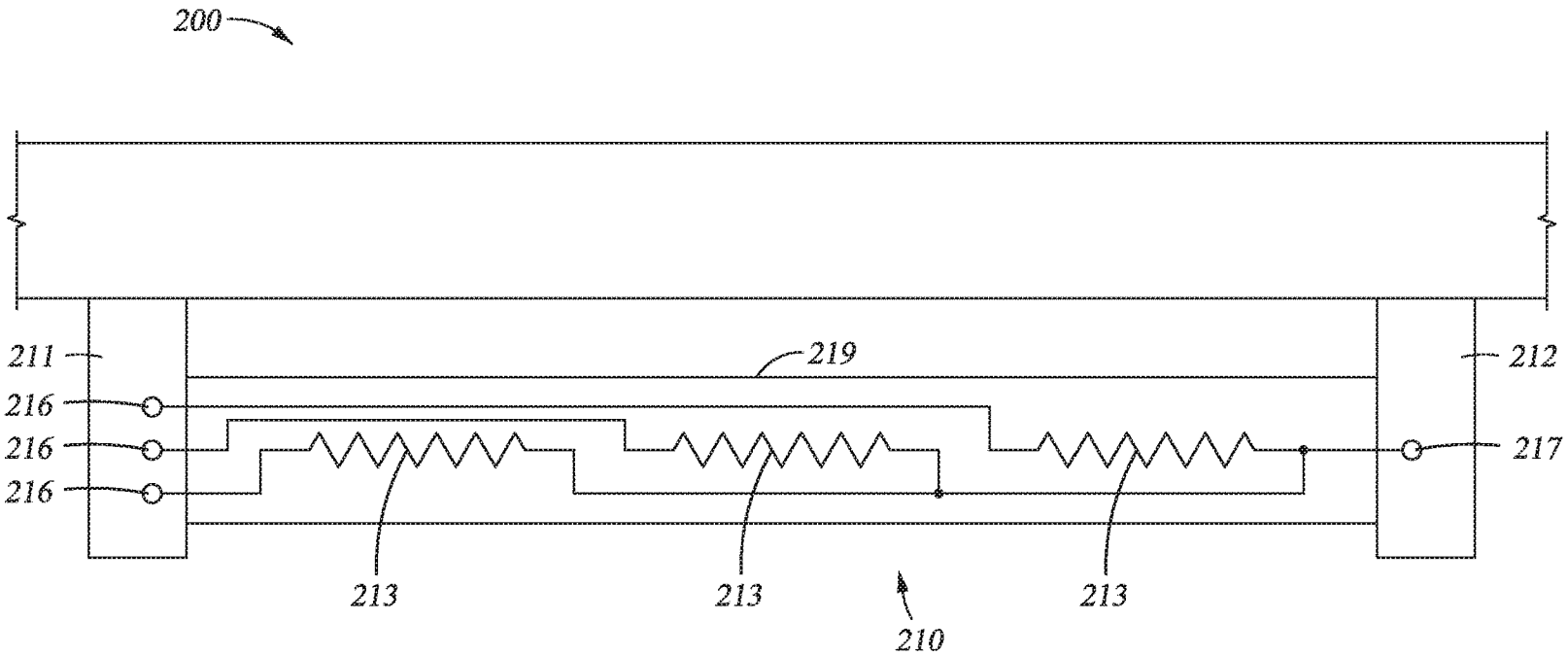
FIG. 2C is a side sectional view of a lamp to be used in the arrangement of lamps in FIGS. 2A and 2B, according to one embodiment.

FIG. 2C is a side sectional view of one embodiment of the linear lamp 210 to be used in the arrangement 207 of lamps in FIGS. 2A and 2B. Each linear lamp 210 can include two or more filaments 213 between the first end 211 and the second end 212 of the linear lamp 210. A bulb 219 can surround the two or more filaments 213. Each linear lamp 210 can also include two or more power supply terminals 216. Each filament 213 in the linear lamp 210 can be electrically connected to a different power supply terminal 216 of that linear lamp 210. Each filament 213 in the linear lamp 210 can further be connected to another terminal 217, such as a common ground or neutral terminal. Conversely, in some embodiments each filament may be connected to a common power supply terminal and a separate power terminal on the neutral or ground side of the electrical connection. Thus, each filament is connected to at least one separate power terminal (i.e., either a separate power supply terminal 216 or a separate ground or neutral side terminal 217). Referring to FIG. 2A, each filament 213 in a linear lamp 210 can be located at a different angular location relative to the center 206 of the plane than the other filaments 213 in that linear lamp 210. Furthermore, each filament 213 in every linear lamp 210 located within a ring-shaped zone, such as the first ring-shaped zone 201, can be located at a different angular location relative to the center 206 than the one or more other filaments 213 of the linear lamps 210 located within the first ring-shaped zone. Connecting the filaments 213 to different power supply terminals allows individual control of the power supplied to the different filaments, which in turn allows separate temperature control of the different angular locations of the process volume 120 in the process chamber 100. In embodiments in which the substrate support does not rotate, the linear lamps 210 can allow separate temperature control over different angular locations of the substrates.

FIG. 2C shows one example of a linear lamp 210 that may be used in the lamphead 200. FIG. 2A shows that the linear lamps 210 in the different ring-shaped zones 201-203 have different lengths from the first end 211 to the second end 212 of these linear lamps 210. In some embodiments, the linear lamps 210 in the ring-shaped zones further from the center 206 of the arrangement 207 than the linear lamps 210 in the other ring-shaped zones closer to the center 206 include additional filaments. In other embodiments, the linear lamps in the ring-shaped zones further from the center 206 of the arrangement 207 include the same number of filaments as the linear lamps in the ring-shaped zones closer to the center 206 of the arrangement 207. In such embodiments, the filaments in the linear lamps in the zones further from the center 206 of the arrangement 207 may be longer than the filaments in the linear lamps 210 closer to the center 206 of the arrangement 207. In still other embodiments, the lamps in each ring-shaped zone may have a same length from the first end 211 to the second end 212 of the linear lamp 210. In such embodiments, the ring-shaped zones further from the center 206 of the arrangement 207 may include more linear lamps 210 than the ring-shaped zones closer to the center 206 of the arrangement 207. Using one type and size of a linear lamp 210 for all of the ring-shaped zones can help reduce spare parts costs.

Figure 3A:
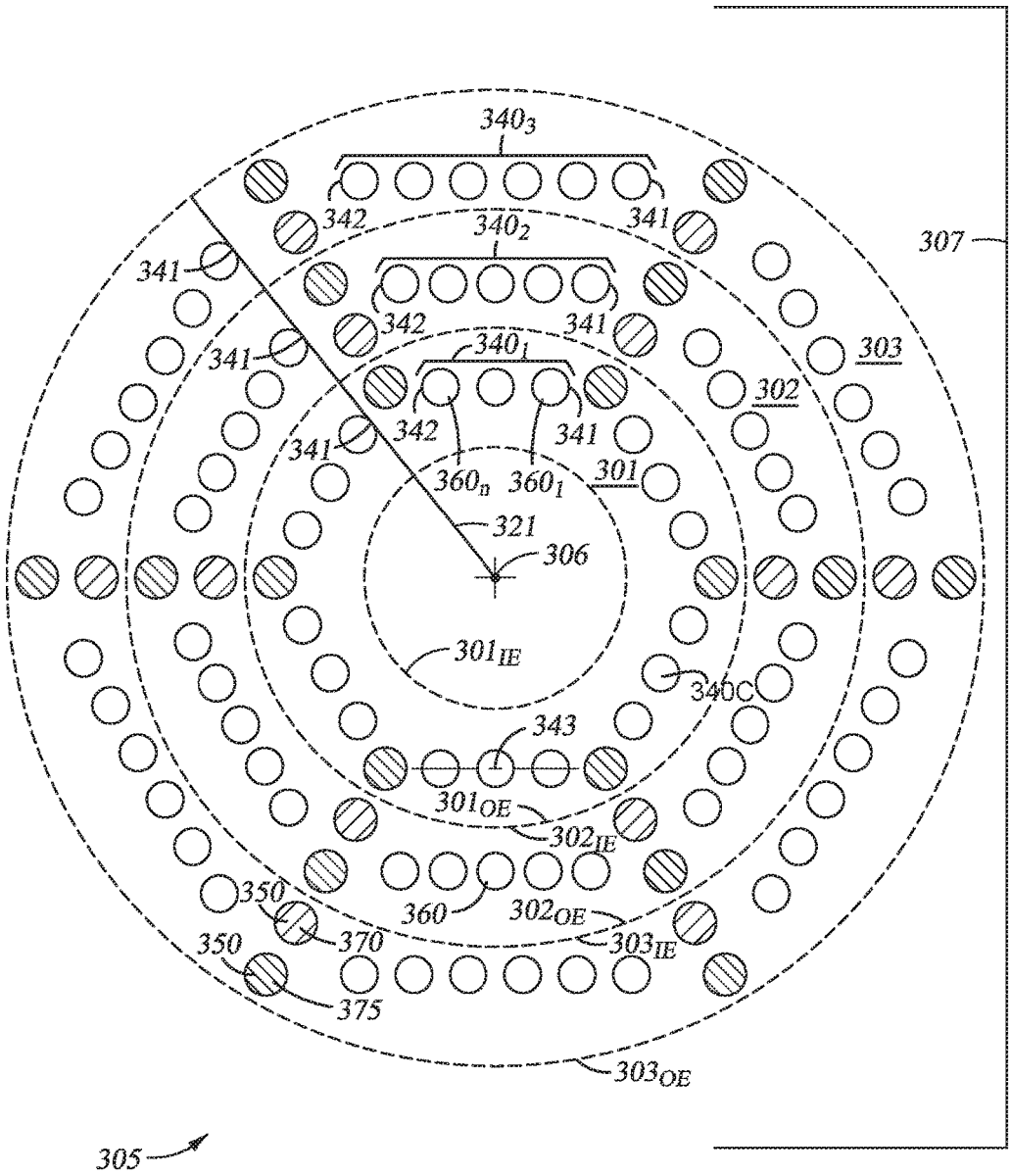
FIGS. 3A and 3B are top sectional plan views of an arrangement of lamps, according to a second embodiment.
Figure 3B:
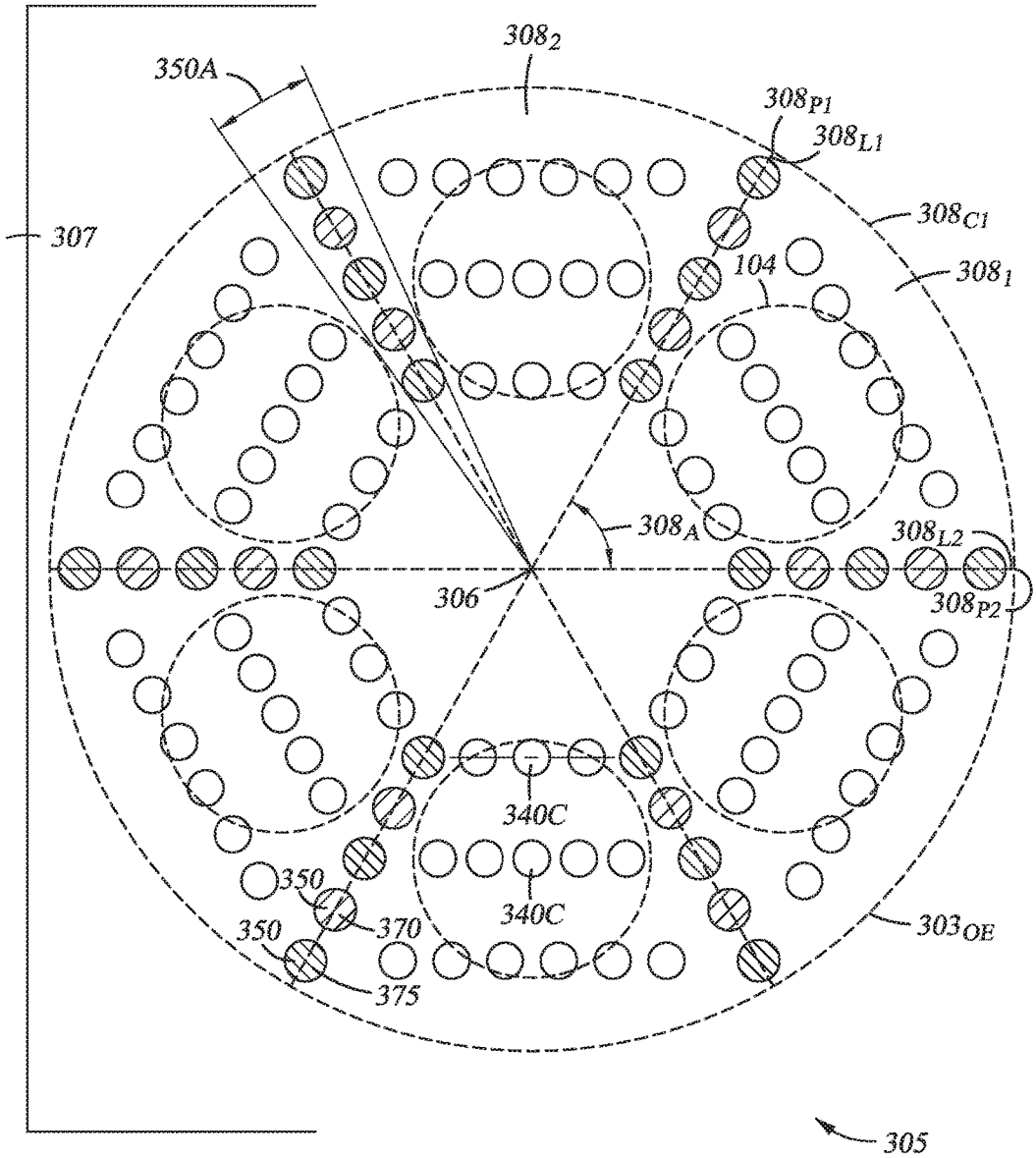

FIGS. 3A and 3B are top sectional plan views of a lamphead 300 including an arrangement 307 of lamps, according to a second embodiment. FIGS. 3A and 3B are essentially the same view of the arrangement 307 of lamps in the lamphead 300 taken from a different perspective. Both FIGS. 3A and 3B illustrate the arrangement 307 of lamps having a center 306 and including a plurality of vertically oriented lamps 360 disposed along a plane 305. FIG. 3A is a view of the arrangement 307 of lamps in a radial perspective, showing the arrangement 307 of lamps divided into concentric ring-shaped zones 301-303. FIG. 3B is a view of the arrangement 307 of lamps using an angular perspective, showing the arrangement 307 of lamps divided into sectors 308 extending from the center 306 of the arrangement 307 of lamps.

Although in FIGS. 3A and 3B the plane 305 is circular, and other references to circular geometry, such as a radial perspective, may be used herein, this disclosure is not limited to circular geometries. For example, a "ring-shaped zone" used herein can refer to any structure in which an inner edge surrounds an interior area and an outer edge surrounds the inner edge. Although this interior area is shown as open area without lamps or other heating sources in some embodiments, this interior area may include lamps or other heating sources.

The arrangement 307 of lamps includes the center 306 that can also be a center of the lamphead 300. The plane 305 over which the arrangement 307 of lamps is disposed can be substantially parallel to the substrate supporting surfaces 107 (see FIG. 1) of the substrate locations 104. The vertically oriented lamps 360 can direct radiation towards substrates located on the substrate supporting surfaces 107 of the substrate locations 104. Examples of suitable lamps to be used as the vertically oriented lamps 360 can include tungsten-halogen lamps, mercury vapor lamps, and carbon filament infrared emitters.

Figure 3C:
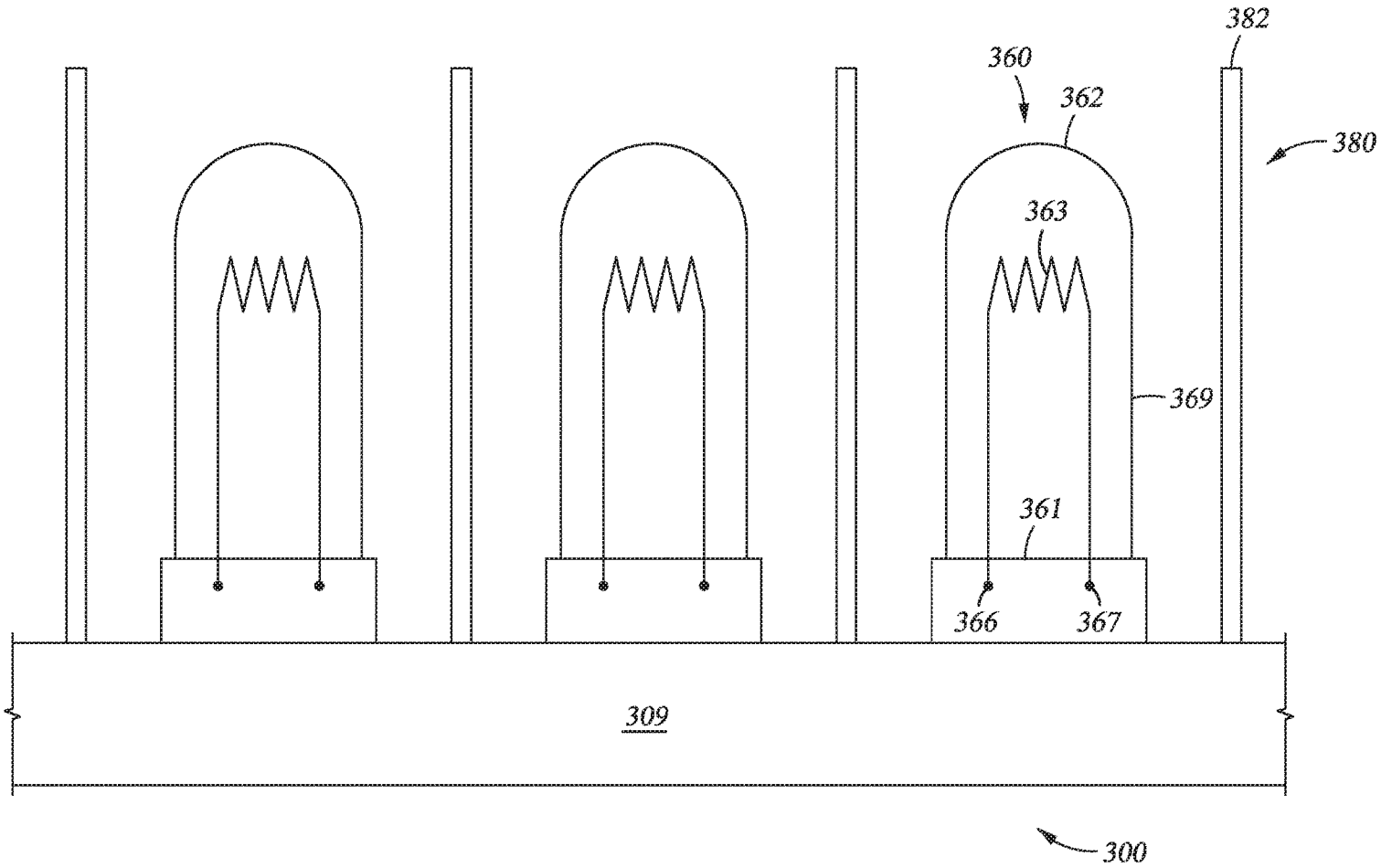
FIG. 3C is a side sectional view of lamps to be used in the arrangement of lamps in FIGS. 3A and 3B, according to the second embodiment.

Referring to FIG. 3A, the arrangement 307 can be divided into the plurality of ring-shaped zones 301-303. Each ring-shaped zone 301-303 may include at least three linear sets 340 of heat sources, such as vertically oriented lamps 360. Each linear set 340 including the three or more vertically oriented lamps 360 may be disposed along a line 343 extending from the first end 341 to the second end 342 of the linear set 340. Each linear set 340 may also be referred to as an alignment of lamps due to the linear extension of the linear set 340 from a first end 341 to a second end 342. The linear sets 340 are described as including vertically oriented lamps 360, but other heat sources may be used. FIG. 3C provides additional detail of an example of vertically oriented lamps 360 that may be used in a linear set 340 of the lamphead 300. Each ring-shaped zone 301-303 can be defined by an inner edge (e.g., $\mathbf{301}_{IE}$, $\mathbf{302}_{IE}$, $\mathbf{303}_{IE}$) and an outer edge (e.g., $\mathbf{301}_{OE}$, $\mathbf{302}_{OE}$, $\mathbf{303}_{OE}$). The ring-shaped zones 301-303 may be non-overlapping, where each ring-shaped zone either surrounds another ring-shaped zone and/or is surrounded by another ring-shaped zone. Furthermore, each ring-shaped zone 301-303 may contact one of the other ring-shaped zones. For example, the outer edge $\mathbf{301}_{OE}$ of a first ring-shaped zone 301 may be the same as the inner edge $\mathbf{302}_{IE}$ of a second ring-shaped zone 302.

Each ring-shaped zone 301-303 includes a plurality of linear sets 340 of heat sources, such as vertically oriented lamps 360. Each linear set 340 may include, for example, from three to fifteen vertically oriented lamps 360, such as from five to eleven vertically oriented lamps 360. Each vertically oriented lamp 360 in a given linear set 340 is disposed linearly with respect to the other vertically oriented lamps 360 in that linear set 340. Each linear set 340 includes a first vertically oriented lamp $\mathbf{360}_1$ at a first end 341 of the linear set 340 and a last vertically oriented lamp $\mathbf{360}_n$ at a second end 342 of the linear set 340. The first end 341 and the second end 342 for each linear set 340 can both be located within one ring-shaped zone, such as the first ring-shaped zone 301. Each linear set 340 located within a ring-shaped zone, such as the first ring-shaped zone 301, can be located at a different angular location relative to the center 306 of the arrangement 307. Furthermore, each linear set 340 located within a ring-shaped zone, such as the first ring-shaped zone 301, may be equidistant from the center 306 of the arrangement 307. For, example a center point 340C of each linear set 340 located within a ring-shaped zone 301-303, such as the first ring-shaped zone 301, may be equidistant from the center 306. Furthermore, in some embodiments, for each given linear set 340 located within a ring-shaped zone, such as the first ring-shaped zone 301, there may be an opposing linear set 340 positioned 180 degrees away from that given linear set 340 and aligned parallel to the given linear set 340. In other embodiments, no two linear sets located within a ring-shaped zone are aligned parallel with each other.

Although FIG. 3A shows that the arrangement 307 of lamps includes three ring-shaped zones 301-303, in some embodiments the plurality of ring-shaped zones can include from two to eleven ring-shaped zones, such as from three to seven ring-shaped zones. In some embodiments, the width of each ring-shaped zone (i.e., the distance between the outer edge and the inner edge of the ring-shaped zone) can be the same, so that uniform spacing between linear sets 340 in directions away from the center 306 can aid in temperature control of the process chambers that are symmetrical about the center of the process chamber. Furthermore, the distance between an outer edge (e.g., outer edge $\mathbf{301}_{OE}$) and an inner edge (e.g., inner edge $\mathbf{301}_{IE}$) of each ring-shaped zone (e.g., first ring-shaped zone 301) can be less than one third of the distance between the center 306 of the arrangement 307 and the outer edge (e.g., outer edge $\mathbf{303}_{OE}$) of an outermost ring-shaped zone (e.g., ring-shaped zone 303).

In some embodiments, each linear set 340 can extend at least 10 degrees or at least 15 degrees around the center 306 of the arrangement 307 from the first end 341 to the second end 342 of that linear set 340. In other embodiments, each linear set 340 can extend at least 30 degrees around the center 306 of the arrangement 307 from the first end 341 to the second end 342 of the linear set 340. For example, in FIG. 3A six linear sets 340 are shown extending around the center 306 in each ring-shaped zone, so these linear sets 340 would extend somewhat less than 60 degrees around the center 306, such as at least 50 degrees due to the spaces between the linear sets 340.

A first end 341 of a first linear set $\mathbf{340}_1$ in the first ring-shaped zone 301 can be positioned at a same angular location 321 relative to the center 306 of the arrangement 307 as a first end 341 of a second linear set $\mathbf{340}_2$ in the second ring-shaped zone 302. In some embodiments, this pattern of having a linear set with a first end located at a same angular location can be repeated for every ring-shaped zone, or other patterns may be used, such as every other ring-shaped zone.

The arrangement 307 of lamps can further include a plurality of additional heat sources 350, such as different types or differently sized vertically oriented lamps 375 and/or a plurality of coherent radiation sources 370. The vertically oriented lamps 375 and the coherent radiation sources 370 can be used to finely tune the temperature control (e.g., hot spots and cold spots) inside the process chamber 100. Each heat source 350, such as a vertically oriented lamp 375 and/or a coherent radiation source 370, may have a surface to emit radiation (e.g., a bulb for the vertically oriented lamp 375) that only extends a few degrees around the center 306, such as less than 10 degrees around the center 306, or less than 5 degrees around the center 306 as shown by the angular area 350A in FIG. 3B. The vertically oriented lamp 375 and the coherent radiation source 370 are only two examples of additional heat sources 350 that can be added to the lamphead 300 to provide fine tuning of the temperature control in the process chamber 100, and other heat sources known in the field may be used as well.

An additional heat source 350, such as a vertically oriented lamp 375 can be positioned at an angular location between each linear set 340 located within some or all of the ring-shaped zones 301-303, such as the first ring-shaped zone 301. Similarly, a coherent radiation source 370 can be positioned at an angular location between each linear set 340 located within some or all of the ring-shaped zones, such as the first ring-shaped zone 301. Although FIG. 3A shows a vertically oriented lamp 375 and/or a coherent radiation source 370 between each linear set 340 in an angular direction, other arrangements are possible. For example, some arrangements may include two or more linear sets 340, in a row in an angular direction or two or more additional heat sources 350, such as coherent radiation sources 370, in a row in an angular direction. Furthermore, in some embodiments, only vertically oriented lamps 375 or only coherent radiation sources 370 may be used as the additional heat sources. Additionally, in some embodiments only linear sets 340 may be used without any additional heat sources 350. The coherent radiation sources 370 and the vertically oriented lamps 375 may be the same as the coherent radiation sources 270 and the vertically oriented lamps 260, respectively, described above and further detail on these additional heat sources 350 is not repeated here.

FIG. 3A shows the linear sets 340 arranged in groups of three, where the first end 341 of each linear set 340 in the group is positioned at a same angular location (see e.g., angular location 321) at different distances from the center 306 of the arrangement 307. Similarly, FIG. 3A shows the vertically oriented lamps 375 and the coherent radiation sources 370 arranged in sets of five, where each vertically oriented lamp 375 and each coherent radiation source 370 is centered along a same angular location. Other embodiments may be contemplated as well, such as embodiments in which the linear sets 340 as well as the vertically oriented lamps 375 and the coherent radiation sources 370 in the different ring-shaped zones are staggered in an angular direction. For example, every linear set 340, vertically oriented lamp 375, and coherent radiation source 370 in the second ring-shaped zone 302 may be offset by 5 degrees from the corresponding linear set 340, vertically oriented lamp 375, and coherent radiation source 370 in the first ring-shaped zone 301. Furthermore, different numbers of lamps may be used in the groups, for example more or less than 3 linear sets 340, and more or less than 5 members in the sets of vertically oriented lamps 375 and coherent radiation sources 370 may be used.

Referring to FIG. 3B, the arrangement 307 can be divided into the plurality of sectors 308. Each sector 308 can be defined by a first leg extending from the center 306 of the arrangement 307 to a first outer point, a second leg extending from the center 306 of the arrangement 307 to a second outer point, and a connecting portion between the first outer point and the second outer point. For example, a first sector $\mathbf{308}_1$ can be defined by a first leg $\mathbf{308}_{L1}$ extending from the center 306 to a first outer point $\mathbf{308}_{P1}$, a second leg $\mathbf{308}_{L2}$ extending from the center 306 to a second outer point $\mathbf{308}_{P2}$, and a connecting portion $\mathbf{308}_{C1}$ between the first outer point $\mathbf{308}_{P1}$ and the second outer point $\mathbf{308}_{P2}$. Each sector 308 can cover a different angular area of the plane 305. For example, the first sector $\mathbf{308}_1$ covers an angular defined by the angle 308A. In some embodiments, each sector can span the same angular area, such as the area defined by angle $\mathbf{308}_A$. The first leg and the second leg of each sector 308 can contact or coincide with a first leg and second leg of other sectors 308, so that the total area of the plane 305 can be filled by the sectors 308. Furthermore, the vertically oriented lamps 375 and the coherent radiation sources 370 can be described as being positioned along a shared leg (e.g., first leg $\mathbf{308}_{L1}$) extending from the center 306 of the arrangement 307 between a first sector $\mathbf{308}_1$ and a second sector $\mathbf{308}_2$. Although FIG. 3B shows that the arrangement 307 of lamps includes six sectors 308, in some embodiments the plurality of sectors can include from two to eleven sectors, such as from three to seven sectors.

As discussed above, each linear set 340 can extend at least 10 or at least 15 degrees around the center 306 of the arrangement 307 from the first end 341 to the second end 342 of that linear lamp 210. In other embodiments, each linear set 340 can extend at least 30 degrees around the center 306 of the arrangement 307 from the first end 341 to the second end 342 of the linear set 340.

Each sector 308 can include a plurality of the linear sets 340 of heat sources, such as vertically oriented lamps 360. The first end 341 and the second end 342 of each linear set 340 can both be located within one sector 308. Each linear set 340 located within a sector 308 can be disposed at a different distance from the center 306 of the arrangement 307. Furthermore, the first end 341 of each linear set 340 located within a sector 308 can be disposed at a same angular location as the first end 341 of the other linear sets 340 located within the same sector 308.

In some embodiments, each sector 308 can overlay a separate substrate location 104. Such a design may be useful when a substrate support does not rotate, so that the temperature of each substrate may be largely controlled by the linear sets of a given sector. Although FIG. 3B is shown with the sectors overlying different substrate support locations, the embodiment of FIG. 3B is only one potential design to be used with the lamp arrangements disclosed herein. For example, in some embodiments two or more sectors may overly one substrate location, or one sector may overly more than one substrate location. Furthermore, this arrangement of lamps also provides benefits for heating single-substrate process chambers. For single-substrate process chambers, the substrate may be placed in a central area of the substrate support and the linear sets may overly this central area as well as the outer areas. In some embodiments to be used with single-substrate process chambers, the center of the lamphead may include an arrangement of closely packed vertically oriented lamps or closely packed coherent radiation sources. In other embodiments, an array of linear sets of heat sources, such as vertically oriented lamps, may overly the central area of the substrate support.

FIG. 3C is a side sectional view of one embodiment of a vertically oriented lamp 360 to be used in the linear sets 340 in the arrangement 307 of lamps in FIGS. 3A and 3B. Each vertically oriented lamp 360 can include one or more filaments 363 located in a bulb 369. Each vertically oriented lamp can include a base 364. Each vertically oriented lamp can also include a bulb 369 extending from a first end located at the base 364 to a second end 362 located at an edge of the bulb 369 opposing the base 364. The base 364 may be mounted to a housing 309 of the lamphead 300. Each vertically oriented lamp 360 can also include a power supply terminal 366 and another terminal 367, such as a common ground or neutral terminal. Terminals 366, 367 may be located in the base 364, and may connect to an electrical circuit to power the vertically oriented lamps 360. Each vertically oriented lamp 360 may be connected to a different circuit. In some embodiments, each vertically oriented lamp 360 may be connected a common electrical circuit. Other electrical configurations are also possible, such as every two or three vertically oriented lamps being connected to a common electrical circuit.

Each vertically oriented lamp 360 may be disposed in a reflective tube 380. Each reflective tube 380 may include one or more side walls 382. A base 383 of each reflective tube 380 may also be formed of a reflective material. Reflective materials that may be used for the one or more side walls 382 and the base 383 include gold, silver, or other metals, and dielectric reflectors. The reflective tubes 380 can be used to prevent the vertically oriented lamps 360 from interfering with each other and enhance the ability of each vertically oriented lamp 360 to control a temperature of a particular region of the process chamber 100 shown in FIG. 1.

Referring to FIG. 3A, each vertically oriented lamp 360 in a linear set 340 can be located at a different angular location relative to the center 306 of the arrangement 307 than the other vertically oriented lamps 360 in that linear set 340. Furthermore, each vertically oriented lamp 360 in every linear set 340 located within a ring-shaped zone, such as the first ring-shaped zone 301, can be located at a different angular location relative to the center 306 than the one or more other vertically oriented lamp 360 of the linear sets 340 located within the first ring-shaped zone 301. Each vertically oriented lamp 360 in a linear set 340 may be connected to a different power supply circuit to allow individual control of the power supplied each vertically oriented lamp 360, which in turn allows separate temperature control of the different angular locations of the process volume 120 in the process chamber 100. In embodiments in which the substrate support does not rotate, the vertically oriented lamps 360 having separate power supply circuits can allow separate temperature control over different angular locations of the substrates.

FIG. 3C shows one example of a vertically oriented lamp 360 that may be used in the lamphead 300. FIG. 3A shows that the linear sets 340 in the different ring-shaped zones 301-303 have different lengths from the first end 341 to the second end 342 due to the linear sets 340 in outer zones, such as ring-shaped zone 303, including more vertically oriented lamps 360, than linear sets 340 in inner zones, such as ring-shaped zone 301. However, in other embodiments, the linear sets in the ring-shaped zones further from the center 306 of the arrangement 307 may include the same number of vertically oriented lamps 360 as the linear sets in the ring-shaped zones closer to the center 306 of the arrangement 307. In such embodiments, the ring-shaped zones further from the center 306 of the arrangement 307 may include more linear sets 340 than the ring-shaped zones closer to the center 306 of the arrangement 307.

The embodiments described herein illustrate lamp arrangements for use in process chambers that can substantially reduce manufacturing costs as well as maintenance costs for the lamphead. The cost savings is achieved by reducing the number of lamps needed in the lamphead. Less lamps require less wiring and less time to mount in the lamphead. Furthermore, less lamps will result in less frequent replacement of lamps resulting in less downtime and maintenance. For example, some lampheads for process chambers include over 400 lamps or even greater than 1,000 lamps. Lamps eventually fail, so operating a process chamber with over 400 lamps will likely require replacing thousands of lamps over the useful life of the lamphead. In many of the embodiments described above, the number of lamps can be maintained below 100 lamps.

Despite the cost savings, the lamp arrangements disclosed here can provide precise temperature control of different areas of the process chamber during processing. Previously used lampheads that included less than 100 lamps generally only provided radial temperature control while azimuthal temperature control was lacking. Conversely, the embodiments disclosed herein provide radial temperature control as well as azimuthal temperature control. For example, the linear lamps described above in reference to FIGS. 2A-2C or the linear sets of lamps described above in reference to FIGS. 3A-3C can be arranged in ring-shaped zones to provide radial temperature control. Furthermore, the linear lamps and the linear sets of lamps can be arranged in sectors to provide azimuthal temperature control. Additionally, some embodiments of the linear lamps described above can include multiple filaments, where each filament is individually powered and positioned at a different angular location in the lamphead, further improving the ability to azimuthally control the temperature in the process chamber. For the embodiment shown in FIGS. 3A-3C, each vertically oriented lamp 360 can be individually powered and positioned at a different angular location in the lamphead to improve the ability to azimuthally control the temperature in the process chamber. Furthermore, using other heat sources, such as vertically oriented lamps and/or coherent radiation sources, between the linear lamps or the linear sets of lamps can further improve the temperature control in the process chamber. Moreover, as shown in FIG. 1, some embodiments can include one of the lampheads 200 or 300 above the substrate support as well as one of the lampheads 200 or 300 below the substrate support to have temperature control ability from either side of the substrate support.

While the foregoing is directed to embodiments of the present disclosure, other and further embodiments of the disclosure may be devised without departing from the basic scope thereof, and the scope thereof is determined by the claims that follow.

The invention claimed is:

1. A process chamber, comprising:

a top, a bottom, and a sidewall coupled together to define a volume;

a substrate support disposed in the volume;

one or more lampheads facing the substrate support, each lamphead of the one or more lampheads comprising an arrangement of lamps disposed along a plane, wherein the arrangement of lamps is defined by a center and a plurality of concentric ring-shaped zones about the center, each ring-shaped zone defined by an inner edge and an outer edge, and each ring-shaped zone comprising three or more alignments of lamps within the arrangement of lamps; wherein:

each lamp of the three or more alignments of lamps comprises a first end extending linearly to a second end;

the first end and the second end are separated by at least 10 degrees around the center;

the first end and the second end are both located within one ring-shaped zone of the plurality of concentric ring-shaped zones;

the three or more alignments of lamps are located within a same ring-shaped zone of the plurality of concentric ring-shaped zones; and the three of more alignments of lamps are positioned equidistant from the center; and a plurality of additional heating sources, wherein a heating source of the plurality of additional heating sources is disposed between each adjacent pair of alignments of lamps of the three or more alignments of lamps.

2. The process chamber of claim 1, wherein the each lamp of the three or more alignments of lamps includes a linear lamp extending from the first end to the second end, each linear lamp-having two or more filaments between the first end and the second end.

3. The process chamber of claim 2, wherein each filament in the each lamp of the three or more alignments of lamps is located within a first ring-shaped zone located at a different angular location relative to the center than one or more other filaments of the each lamp of the three or more alignments of lamps located within the first ring-shaped zone.

4. The process chamber of claim 3, wherein the each lamp of the three or more alignments of lamps includes three or more power terminals and each filament in each lamp of the three or more alignments of lamps is electrically connected to at least one different power terminal than the one or more other filaments of the each lamp of the three or more alignments of lamps.

5. The process chamber of claim 2, wherein the each lamp of the three or more alignments of lamps extends at least 15 degrees around the center from the first end to the second end.

6. The process chamber of claim 2, wherein the each lamp of the three or more alignments of lamps extends at least 30 degrees around the center from the first end to the second end.

7. The process chamber of claim 2, wherein the plurality of concentric ring-shaped zones comprises from three to seven ring-shaped zones.

8. The process chamber of claim 2, wherein a first end of a first lamp in a first ring-shaped zone is positioned at a same angular location relative to the center as a first end of a second lamp of the three or more alignments of lamps in a second ring-shaped zone.

9. A process chamber, comprising:

a top, a bottom, and a sidewall coupled together to define a volume;

a substrate support disposed in the volume; and a lamphead facing the substrate support, the lamphead comprising an arrangement of lamps disposed along a plane, wherein the arrangement of lamps is defined by a center and three or more sectors, each sector of the three or more sectors defined by a first leg extending from the center to a first outer point, a second leg extending from the center to a second outer point, and a connecting portion between the first outer point and the second outer point, the each sector of the three or more sectors comprising a plurality of linear lamps, wherein:

each linear lamp of the plurality of linear lamps comprises a first end and a second end that are separated by at least 10 degrees around the center; wherein:

the first end and the second end of the each linear lamp of the plurality of linear lamps are both located within one sector of the three or more sectors; and the each linear lamp of the plurality of linear lamps of the each sector of the three or more sectors is located at a different distance from the center; and a plurality of heat sources positioned along the first leg and the second leg of the each sector of the three or more sectors, wherein a surface to emit radiation of each heat source of the plurality of heat sources extends less than 5 degrees around the center.

10. The process chamber of claim 9, wherein the each linear lamp of the plurality of linear lamps further comprises two or more filaments between the first end and second end.

11. The process chamber of claim 10, wherein each filament in a first linear lamp is located at a different angular location relative to the center than one or more other filaments in the first linear lamp.

12. The process chamber of claim 9, wherein the each linear lamp of the plurality of linear lamps extends at least 15 degrees around the center from the first end to the second end.

13. The process chamber of claim 9, wherein the each linear lamp of the plurality of linear lamps extends at least 30 degrees around the center from the first end to the second end.

14. The process chamber of claim 9, wherein the three or more sectors comprises from three to seven sectors.

15. The process chamber of claim 9, further comprising a plurality of coherent radiation sources positioned along the first leg and the second leg of the each sector of the three or more sectors.

16. A process chamber, comprising:

a top, a bottom, and a sidewall coupled together to define a volume;

a substrate support disposed in the volume, the substrate support having a plurality of substrate locations distributed around a central location of the substrate support, each substrate location having a substrate supporting surface; and a lamphead facing the substrate support, the lamphead comprising an arrangement of lamps disposed along a plane that is parallel to the substrate supporting surfaces of the substrate locations, wherein the arrangement of lamps is defined by a center, from three to seven ring-shaped zones, and from three to seven sectors overlapping the from three to seven ring-shaped zones; wherein:

each ring-shaped zone of the from three to seven ring-shaped zones is concentric with the center and the each ring-shaped zone is defined by an inner edge and an outer edge;

each sector of the from three to seven sectors is defined by a first leg extending from the center to a first outer point, a second leg extending from the center to a second outer point, and a connecting portion between the first outer point and the second outer point;

each linear lamp of the arrangement of lamps comprises a first end and a second end that are both located within one ring-shaped zone of the three to seven ring-shaped zones and one sector of the from three to seven sectors, wherein the each linear lamp of the arrangement of lamps extends at least 30 degrees around the center of the plane; and a plurality of heat sources positioned along the first leg and the second leg of the each sector of the from three to seven sectors, wherein a surface to emit radiation of each heat source of the plurality of heat sources extends less than 5 degrees around the center.

* * * * *